US005727924A

United States Patent [19]

Hummel et al.

[11] Patent Number: 5,727,924

[45] Date of Patent: Mar. 17, 1998

[54] PALLET CONSTRUCTION FOR AUTOMATED STACK PROCESSING

[75] Inventors: Peter Hummel, Offenbach am Main; Robert Ortner, Alzenau, both of Germany

[73] Assignee: MAN Roland Druckmaschinen AG, Germany

[21] Appl. No.: 643,000

[22] Filed: May 2, 1996

[30] Foreign Application Priority Data

May 4, 1995 [DE] Germany ..... 195 16 039.8

[51] Int. Cl.[6] ..... B65H 31/30

[52] U.S. Cl. ..... 414/790; 414/790.8; 271/158

[58] Field of Search ..... 414/790, 790.8, 414/791.9, 799, 786; 271/158, 159; 108/51.1, 157, 159

[56] References Cited

U.S. PATENT DOCUMENTS

| | | | |
|---|---|---|---|
| 2,734,744 | 2/1956 | Backhouse | 271/159 |
| 2,898,105 | 8/1959 | Schmidt | 271/159 |
| 3,180,638 | 4/1965 | Meylan | 271/159 |
| 4,195,963 | 4/1980 | Levkoff et al. | 414/790 |
| 4,222,697 | 9/1980 | Vits | 414/790.8 |
| 5,538,238 | 7/1996 | Filsinger | 271/159 |

FOREIGN PATENT DOCUMENTS

| | | | |
|---|---|---|---|
| 926251 | 3/1955 | Germany | 271/159 |
| 1 797 252 | 10/1959 | Germany . | |
| 667 767 | 10/1962 | Germany . | |
| 77 448 | 10/1970 | Germany . | |
| 43 44 361 A1 | 9/1994 | Germany . | |

*Primary Examiner*—Karen B. Merritt
*Assistant Examiner*—Douglas Hess
*Attorney, Agent, or Firm*—Leydig, Voit & Mayer, Ltd.

[57] ABSTRACT

A pallet construction for use in conjunction with transport apparatus in a sheet-processing system includes spaced grooves adapted to receive automated insertion apparatus. The pallet construction includes webs separated by spaced grooves disposed to receive levelling elements. The levelling elements are movable relative to the webs to provide a relatively planar pallet surface and prevent the deformation of printed sheets. The construction also permits exposure of the grooves as desired.

9 Claims, 3 Drawing Sheets

PALLET CONSTRUCTION FOR AUTOMATED STACK PROCESSING

FIELD OF THE INVENTION

This invention generally relates to the sheet processing art, and in particular to a pallet construction with one or more movable levelling elements that provide additional support surfaces for the pallet in automated processing of sheet material.

BACKGROUND OF THE INVENTION

Pallets with longitudinal grooves are known for automated processing of sheet material stacks in graphics machines and the like. Such grooves form a discontinuous stack carrying surface upon which the sheet material is placed. This construction permits the reception of carrying means within the grooves to readily engage partial stacks of sheet material and transport the same to a desired location if necessary. Such action is typically desired, for example, during a changeover operation when an uninterrupted supply of unprocessed sheet material is loaded onto the pallet and when an uninterrupted discharge of processed sheet material is loaded onto the pallet.

A pallet of this general type is disclosed in German Utility Model 1797252. That document describes an auxiliary grid for stacking platforms formed from a stacking board with separately attached strips mounted thereon. The strips along with the stacking board provide spaced groove-like longitudinal depressions upon which the sheet material is placed. Suitable sheet carrying apparatus with extending fingers or bars are placed into the depressions in order to remove the stacked sheet material from the stacking board.

One disadvantage besetting this known pallet construction is that the stacked sheet material tends to sag into the depressions. This results in deformation of the sheet material and in damage to printed images and the like when the sheet material is removed, particularly in the delivery region.

A proposed solution to this problem is found in DE 4344361 A1. This document discloses an apparatus used in forming individual stacks of sheet material. The apparatus comprises a grooved pallet for automated reception of sheet stacks at a delivery section of a printing machine. In order to avoid sagging of the sheet material in the region of the grooves, the apparatus includes an auxiliary board placed in overlying relation to plural auxiliary stacking fingers interposed between the pallet grooves. Thus, the auxiliary board covers the grooves. However, automated processing is impossible when the auxiliary board is positioned on top of the stacking fingers since it must later be manually removed. At best, only partial-stack formation is possible with this arrangement.

OBJECTS OF THE INVENTION

Accordingly, known arrangements now fail to adequately meet requirements for processing stacked sheet material, particularly in commercial settings. It is therefore a general object of the present invention to overcome the deficiencies in the prior art.

Another object of the invention is to provide a pallet construction which prevents deformation of stacked sheet material during various handling operations thereof.

It is another object of the invention to provide a pallet construction that readily permits access by automated processing equipment.

SUMMARY OF THE INVENTION

The present invention provides these and other additional objects and advantages with a pallet construction having movable levelling elements adapted to provide additional support to stacked sheet material when desired. In one preferred embodiment, the pallet construction comprises a pallet body with spaced longitudinal webs, each of which provides an exposed stack rest surface. The webs are separated by spaced longitudinal grooves adapted to receive conventional stack carrying means. A plurality of movable levelling elements are disposed in the grooves and in one operable mode cooperate with the stack rest surfaces to present a substantially planar support surface for the sheet material. In another mode, the levelling elements are moved to expose the grooves and permit accessibility by the stack carrying means.

BRIEF DESCRIPTION OF THE DRAWINGS

The invention is described in more detail below with reference to drawings, in which.

DETAILED DESCRIPTION OF THE PREFERRED EMBODIMENTS

Generally, the present invention relates to a pallet construction that includes spaced webs separated by grooves that receive levelling elements. The levelling elements are operable to cooperate with the webs to support stacked sheet material. The pallet construction is particularly intended for use in conjunction with automated transport apparatus in a sheet processing system.

Figure 1:
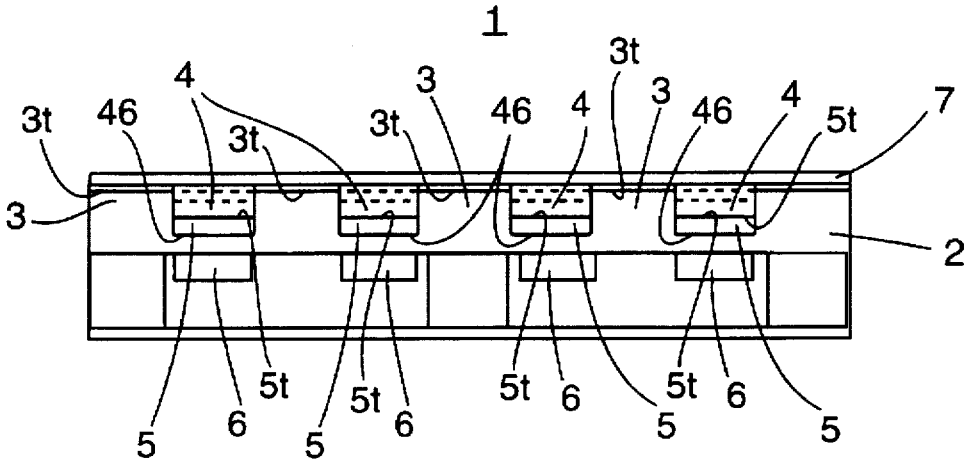
FIG. 1 is a side view of a pallet construction according to one preferred embodiment of the invention.

Turning first to FIG. 1, there is shown a pallet construction according to this invention. The construction comprises a pallet body 1 which includes a plurality of longitudinal webs or web-like protrusions 3 disposed in spaced relation on a carrying board 2. FIG. 1 also shows a plurality of complemental grooves 4 located between the webs 3. This construction permits ready access of auxiliary stack carriers or other suitable sheet lifting and transport apparatus as will be understood by those skilled in the art. In particular, such apparatus typically includes engagement forks or the like that are inserted longitudinally into the grooves 4 in order to lift sheet material stacked onto the webs 3 of the pallet body 1.

In accordance with one important aspect of the invention, means are included to provide additional support to the stacked sheet material. This is accomplished in the embodiment shown in FIG. 1 with the use of plural levelling elements 5 disposed proximate to the base 4*b* of the grooves 4. The levelling elements 5 preferably span the lengthwise dimension of the respective grooves and are movable relative to the top or stack rest surfaces 3*t* of the webs. In one operative mode, the top surfaces 5*t* of the levelling elements 5 can be raised to a position substantially flush with the top surfaces of the webs 3 to provide a relatively uniform support surface. In FIG. 1, this operative mode is represented by dashed lines.

To effect movement of the levelling element top surfaces 5*t* to a position that is substantially flush with the top surfaces 3*t* of the webs, a plurality of lifting means are incorporated into the pallet construction. This is accomplished in the embodiment shown in FIG. 1 with complemental lifting devices shown schematically as element 6. While the details of the lifting devices have been omitted, it will be understood that they may be readily formed by conventional means. For example, the lifting devices may be implemented with a lever arrangement, an eccentric piece providing a cam surface, a wedge or other suitable arrangement. The lifting devices 6 are arranged such that engagement openings on the underside of the pallet body 1 (not shown) are unrestricted. Such engagement openings are typically provided in pallets of this nature so that they may be readily conveyed as will be understood by those skilled in the art. Normal stack transportation is thus not obstructed.

In accordance with another important advantage of the invention, a substantially planar rest surface is provided for the stacked sheet material through alignment of the web top surfaces and the levelling element top surfaces. In FIG. 1, this mode is achieved when the levelling elements 5 are moved upwardly via actuation of the respective lifting devices 6 until each of their top surfaces are substantially flush with the top surfaces of the webs. Accordingly, a printed sheet such as sheet 7 resting on the pallet body 1 has a continuous rest surface.

Preferably, each of the lifting devices 6 are controlled together in order to provide a planar stack carrying surface or to release the levelling elements from the grooves 4 to expose each of the grooves. However, in another preferred embodiment of the invention, the lifting devices 6 are selectively activated. In this way, certain ones of the grooves 4 may be permanently closed or remain exposed as desired.

Figure 2:
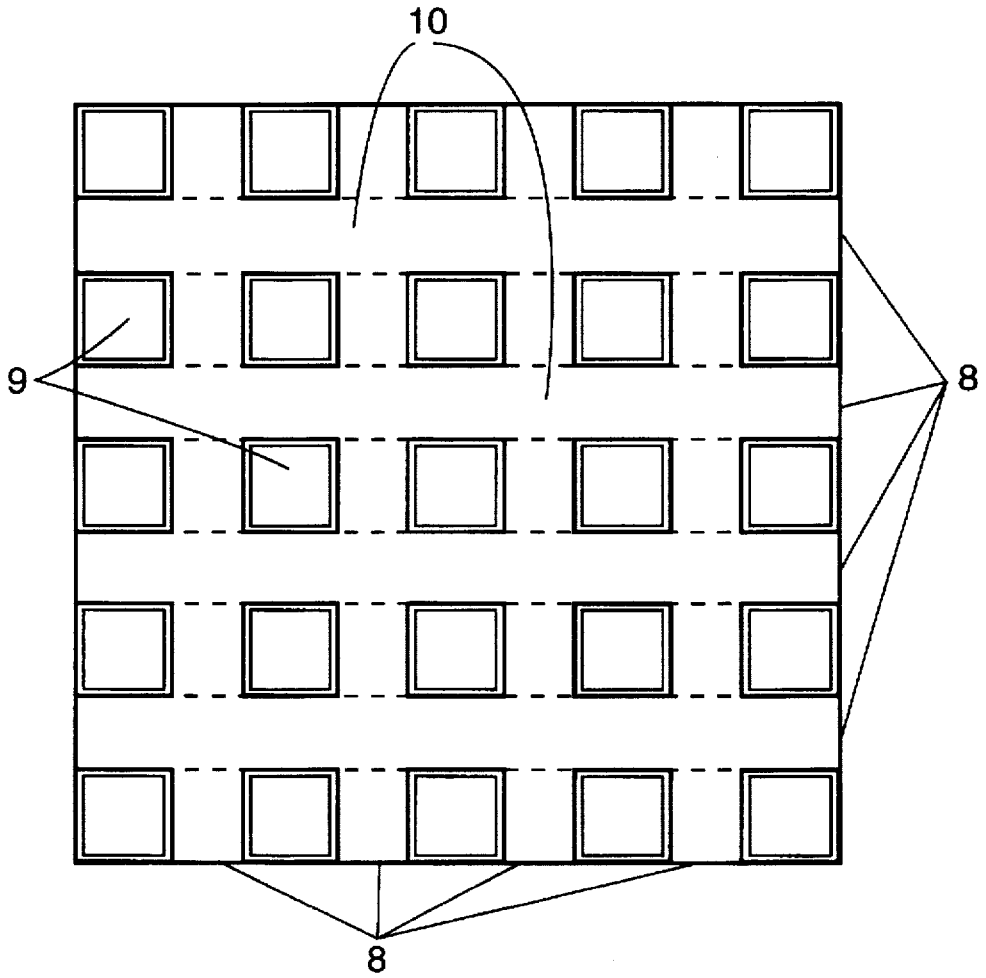
FIG. 2 is a plan view of a pallet construction according to a second embodiment of the invention.

In accordance with another embodiment of the invention, a pallet construction includes a groove pattern formed from spaced longitudinal and transverse grooves. Such a construction is shown in FIG. 2. In this embodiment, a plurality of spaced longitudinal and transverse grooves 8 formed in a pallet body define complemental rectangular webs. A plurality of exposed stack carrying surfaces is thereby provided by rectangular rests 9.

FIG. 2 also shows a unitary levelling grid 10 comprising spaced longitudinal and transverse bands sized to interfit within the grooves 8. In this way, the levelling grid 10 circumscribes most or all of the levelling rests 9. In this embodiment, a lifting device (not shown) is incorporated to provide raising action over the entire surface of the levelling grid 10.

Alternatively, the levelling grid 10 may be comprised of individual linear levelling elements such as the levelling elements 5 shown in FIG. 1 (and shown in dashed lines in FIG. 2). In this alternative embodiment a relatively small free space exists between the rests 9 and the levelling elements in which the printed sheet material 7 is unsupported. The actual size of this free space, of course, depends on the dimension and orientation of the levelling elements. Although a slight free space may exist, it is far more acceptable than fully exposed or open grooves 3 or an exposed or open groove pattern as was customary in the prior art.

In order to utilize the pallet construction according to the embodiments of FIGS. 1 and 2 in a sheet processing application, the following steps typically occur. Initially, a stack of sheet material is supplied to a feeding section of sheet-processing apparatus as will be understood by those skilled in the art. For this operation, each of the levelling elements (or the levelling grid) is positioned in the operative mode wherein their top surfaces are substantially planar with the top surfaces of the webs. The supported sheet stack is thus in the optimum state for processing.

In order to effectuate an automated stack changeover in the feeding section, the lifting devices 6 are actuated by remote control or the like, for example from the feeding section, in order to urge the levelling elements or levelling grid to a second operable mode. In this mode, the grooves are at least partially exposed to permit access of fingers of an auxiliary stack carrying device into the exposed grooves 4. Inasmuch as only a relatively small amount of printing sheet material is supported by the pallet body during this operation, it is unnecessary to provide additional support to the stack with the levelling elements.

Upon removal of the pallet body 1 from the feeding section, it may be transported to a delivery section for further use. The delivery section is typically located at the opposite end of the sheet-processing apparatus. The delivery section likewise utilizes auxiliary stack carrying apparatus of the known type with bar-like or rake-like fingers adapted to be received within exposed grooves of the pallet. A partial stack of sheet material is then positioned on the auxiliary stack carrying device associated with the delivery unit.

Inasmuch as the pallet grooves 4 are exposed, the pallet body 1 may be lifted to a position wherein the stack carrying device fingers are registered with the pallet grooves. In this position, the webs 3 are in abutting engagement with, and provide support for, the underside of the partial stack of sheet material.

Upon removal of the auxiliary stack carrying device, the pallet lifting devices 6 are activated. As described above in connection with the feeding unit, the pallet lifting devices 6 may be activated by remote control from the delivery unit. The exposed stack carrying surface is thereby rendered substantially planar by cooperation of the webs 3 and the raised levelling elements 5. In the preferred implementation of the invention, this stage of processing is synchronized with the remaining components of the printing machine so that a relatively small number of sheets are supported on the pallet body 1. This minimizes risk of damage to printed images and the like on the sheet material.

In order to utilize the pallet construction according to the embodiment shown in FIG. 2, it is possible to use different auxiliary stack carrying device structures, even in conjunction with the same sheet-processing machine. Of course, the methodology described herein is also applicable to further sheet stack processing in other systems.

Figure 3:
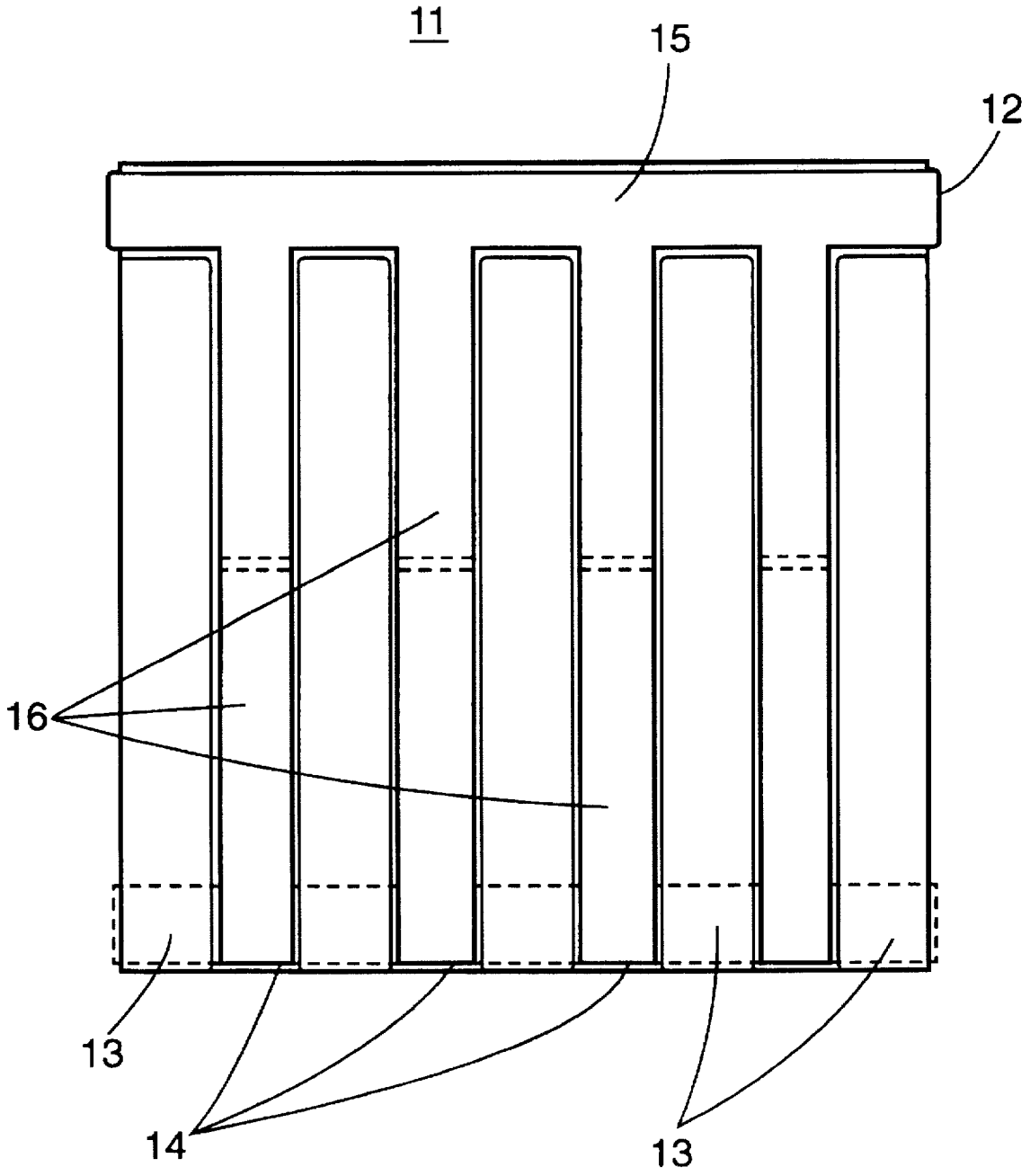
FIG. 3 illustrates a pallet construction according to another embodiment of the present invention.

FIG. 3 shows another embodiment of the present invention particularly suited to accommodate an automated stack changeover in a sheet-processing machine. As shown therein, the pallet construction includes a pallet body 11 comprising spaced longitudinally extending webs 13 separated by corresponding spaced grooves 14. FIG. 3 also shows a unitary levelling member 12 used in conjunction with the pallet body. The levelling member 12 comprises a transverse web 15 interconnected with a plurality of spaced, longitudinal carrying fingers or rods 16 extending from the transverse web 15. The carrying fingers 16 are sized and dimensioned to register with and interfit between webs 13 within the grooves 14. In order to accommodate the levelling member 12, the webs 15 are preferably reduced in length at their respective ends. This enables the transverse web 15 to mate with the pallet body 11 in overlying relation at one end.

Alternatively, an arrangement may be provided with a pair of opposed levelling members 12 inserted into the grooves 14 from the opposite ends of the pallet body 11 (shown in dashed lines in FIG. 3). In either embodiment, the orientation of the pallet is optimized such that the web length is reduced at pallet ends which are not utilized for edge alignment of the sheet stack. Alternatively, the transverse web 15 may be disposed to the exterior of the pallet body 11.

Figure 4:
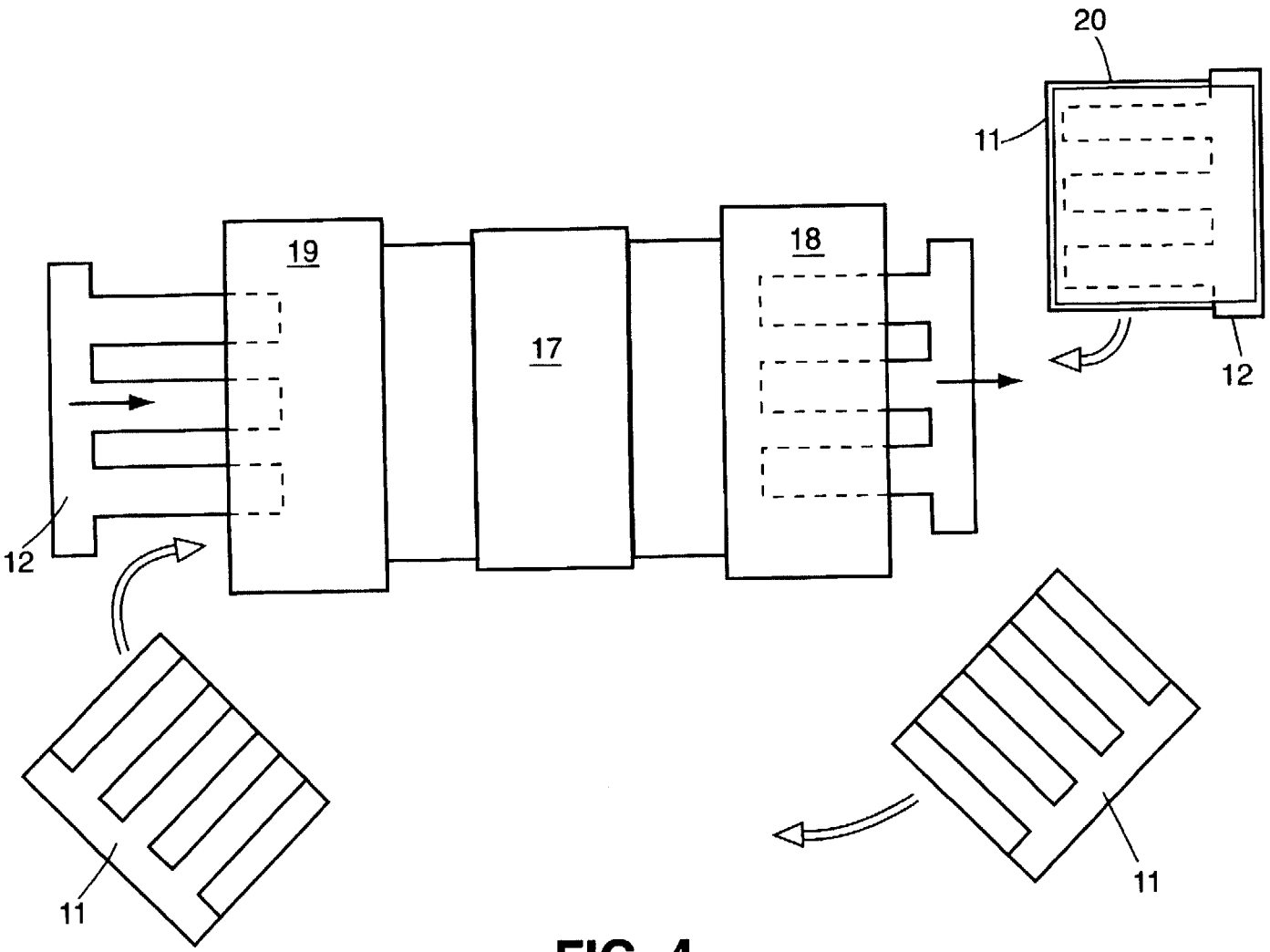
FIG. 4 illustrates a simplified operational diagram of a method for utilizing the pallet construction of FIG. 3.

In order to perform sheet stack changeover with a sheet-processing machines using this pallet construction, reference is made to the diagrammatic representation shown FIG. 4. As shown there, a sheet-processing station 17 includes a feeding section 18 and a delivery section 19. In a first processing operation, a sheet stack 20 is supplied to the feeding section 18. During this operation, a levelling member 12 is placed within the pallet body 11 subjacent to the sheet stack 20. This presents a relatively smooth surface to the sheet stack 20. In addition, the transverse web 15 of the levelling member 12 projects beyond the edges of the sheet stack 20.

When a substantial portion of the sheet stack 20 in the feeding section 18 has been processed, the transverse web 15 (and any portion of the fingers 16 proximate to the transverse web) is engaged by an auxiliary lifting device of the type known to those skilled in the art disposed at the feeding section 18. The remaining portion of the sheet stack 20 continues to be processed while the pallet body 11 is lowered and removed from the feeding section 18. Preferably, the pallet body 11 is transported in an appropriate manner to the delivery section 19.

As a new sheet stack is introduced to the feeding section 18 and raised, the levelling member 12 is drawn out by means of the auxiliary lifting device. This results in the remainder of the old stack resting on the new sheet stack 20. The levelling member 12 is thereafter used again in accordance with the steps set forth above.

FIG. 4 also schematically shows a stack changeover in connection with the delivery unit 19. The levelling member 12 and the pallet body 11 are initially brought to the delivery section 19. During the next stack changeover, that is, when a full delivery stack has been processed, the levelling member 12 is inserted into an auxiliary lifting device provided at the delivery section 19. A partial stack may then be formed on the levelling member 12 with the use of the auxiliary lifting device until the stack changeover is completed.

By raising the pallet 11 in registry with the levelling member 12, the pallet 11 and levelling member 12 cooperate to present a smooth, relatively planar rest surface for the stack of printed sheets. Damage to the printed image on the printed sheet is thereby eliminated. The outlined sequence provides a circulatory operation for the pallets 11 and the levelling members 12.

It should be understood that the number of carrying fingers 16 may differ from the number of grooves 14 in the pallet body 11. Depending on the material being processed, it may be sufficient to place carrying fingers 16 in alternating grooves. Likewise, it is also contemplated that two or more relatively narrow carrying fingers 16 may be adapted for placement within one pallet groove 14. Moreover, the number and lateral spacing of the grooves 4, 8, 14 in the pallet configurations 1, 11 shown in the drawings are not necessarily restricted to the configurations of the preferred embodiments described or illustrated herein.

Manual handling of the levelling member 12 in conjunction with the described stack changeover procedures at the feeding or delivery sections is also contemplated by the invention. In this regard, the levelling member 12 is not utilized when a stack of sheet material 20 is supplied to the feeding section 18. This action occurs only in conjunction with steps carried out at the delivery section 19. Of course, the transportation of the pallets 11 and of the levelling elements 12 may also be automated.

Automated handling of the levelling members 12 during stack changeover in the feeding section 18 or delivery section 19 is comparable with the known systems for so-called non-stop stack changeover and will therefore not be described in detail herein. The auxiliary lifting devices contemplated herein are those which, during the stack changeover, and as a partial stack is formed therefor, can raise or lower the stack. Furthermore, the introduction of the levelling members 12 into the delivery region 19 and/or the feeding section 18, and the removal of the levelling members 12 therefrom may alternatively be performed manually as appropriate for a particular application.

Accordingly, a novel pallet construction meeting the aforestated objectives has been described. The construction includes spaced webs separated by grooves that accommodate appropriate levelling means which cooperate with the webs to present a substantially planar surface for a stack of sheet material. This eliminates the risk of damage to the sheet material. In addition, the levelling means are removable from the grooves to permit ready access by suitable sheet stack lifting apparatus. The invention, however, is not limited to the particular constructions and methods of use described herein. Rather, it is intended to encompass other modifications as would be apparent to one of ordinary skill in the art, particularly upon consideration of the foregoing teachings.

What is claimed is:

1. A pallet construction for stacking printed sheet material in an automated sheet-processing system including auxiliary stack lifting apparatus with an auxiliary stack carrier, the pallet construction comprising:

a pallet body including a plurality of web-like protrusions having corresponding stack rest surfaces thereon, each of the protrusions separated by spaced, longitudinal grooves adapted to receive the auxiliary stack carrier when the grooves are exposed; and a plurality of levelling elements adapted for reception within the grooves and being movable therein between first and second operative modes, each of the levelling elements including a top surface which, in the first operative mode, cooperates with the stack rest surfaces to present a substantially planar surface subtending the sheet material, and in the second operative mode, is moved downwardly from the rest surfaces of the web-like protrusions to expose a corresponding one of the grooves while still being disposed within the grooves to permit reception of the auxiliary stack carrier above the leveling elements.

2. The invention as in claim 1 wherein the levelling elements are retained in the pallet body and are movable within the grooves relative to the stack rest surfaces of the web-like protrusions such that in the first operable mode the top surfaces of the levelling elements are substantially flush with the stack rest surfaces.

3. The invention as in claim 2 wherein the levelling elements comprise a plurality of webs having a transverse dimension substantially matched with the grooves of the pallet body.

4. The invention as in claim 2 wherein the levelling elements are moveable within the grooves of the pallet body with the use of a lifting device operatively connected to the pallet body.

5. The invention as in claim 4 wherein the levelling elements form a levelling grid having a pattern corresponding with the grooves, the levelling grid surrounding each of the stack rest surfaces of the pallet body.

6. The invention as in claim 4 wherein the levelling elements comprise a plurality of webs having a transverse dimension substantially matched with the grooves of the pallet body.

7. A pallet construction for stacking printed sheet material in an automated sheet-processing system including a feeding section, a delivery section, and an auxiliary stack lifting apparatus, the pallet construction comprising:

a pallet body including a plurality of webs having corresponding stack rest surfaces thereon, each of the webs separated by spaced, longitudinal grooves adapted to receive the auxiliary stack lifting apparatus when the grooves are exposed; and a levelling grid including a plurality of longitudinal spaced fingers connected at one end to a transverse support member, each of the fingers interdigitated between the webs with top surfaces cooperating with the stack rest surfaces to present a substantially planar surface subtending the printed sheet material in a first operable mode, the levelling grid fingers being movable downwardly within the grooves to a second operative mode to expose the grooves of the pallet body.

8. The invention as in claim 7 wherein the levelling grid includes means for connection to the auxiliary stack lifting apparatus and wherein the auxiliary stack lifting apparatus includes means for retaining the levelling grid such that the levelling grid can be automatically raised and lowered in the feeding section and delivery section, and inserted therein or removed therefrom.

9. The invention as in claim 7 wherein the levelling grid includes means for connection to the auxiliary stack lifting apparatus such that the levelling grid can be automatically transported.

* * * * *